US005211772A

United States Patent [19]

Ashida et al.

[11] Patent Number: 5,211,772

[45] Date of Patent: May 18, 1993

[54] WIRE ROD FOR HIGH STRENGTH AND HIGH TOUGHNESS FINE STEEL WIRE, HIGH STRENGTH AND HIGH TOUGHNESS FINE STEEL WIRE, TWISTED PRODUCTS USING THE FINE STEEL WIRES, AND MANUFACTURE OF THE FINE STEEL WIRE

[75] Inventors: Shinzo Ashida, Nishinomiya; Nobuhiko Ibaraki, Akashi; Katsuji Mizutani, Kakogawa; Kenji Ochiai, Kobe, all of Japan

[73] Assignee: Kabushiki Kaisha Kobe Seiko Sho, Kobe, Japan

[21] Appl. No.: 813,686

[22] Filed: Dec. 27, 1991

[30] Foreign Application Priority Data

Dec. 28, 1990 [JP] Japan ..... 2-415971
Apr. 6, 1991 [JP] Japan ..... 3-102040
Dec. 7, 1991 [JP] Japan ..... 3-349551

[51] Int. Cl.[5] ..... C22C 38/10; C22C 38/08; C21D 8/06

[52] U.S. Cl. ..... 148/336; 148/595; 148/320; 420/99; 420/119

[58] Field of Search ..... 148/595, 320, 333, 334, 148/335, 336; 420/119, 99

[56] References Cited

U.S. PATENT DOCUMENTS 3,984,238 10/1976 Vlasov et al. .

FOREIGN PATENT DOCUMENTS 53-56122 5/1978 Japan ..... 148/333
2174407 11/1986 United Kingdom .

OTHER PUBLICATIONS

Pasarica, Victoria et al., "The Nonmetallic Inclusion Nature and Dispersion in Electric-Furnace Steels for Prestressed Wire Traction Wire and Special Spring-wire" Cercel. Metal., 24, 1983, 291-314.

*Primary Examiner*—Deborah Yee
*Attorney, Agent, or Firm*—Oblon, Spivak, McClelland, Maier & Neustadt

[57] ABSTRACT

The fine steel wire according to the present invention has a high strength and high toughness, which is used as a rubber reinforcing material for a belt cord or tire cord, or as missile wires. Such a fine steel wire can be obtained by drawing a wire rod for a fine steel wire properly adjusted in its composition and structure, while applying working strain such that the total reduction of area in the final wire drawing step becomes 95% or more.

13 Claims, 4 Drawing Sheets

WIRE ROD FOR HIGH STRENGTH AND HIGH TOUGHNESS FINE STEEL WIRE, HIGH STRENGTH AND HIGH TOUGHNESS FINE STEEL WIRE, TWISTED PRODUCTS USING THE FINE STEEL WIRES, AND MANUFACTURE OF THE FINE STEEL WIRE

BACKGROUND OF THE INVENTION

1. Field of the Invention

The present invention relates to a low alloy fine steel wire having high tensile strength and high toughness used as a rubber reinforcing material for a belt cord, tire cord, etc., as a material for a miniature rope and as a missile wire, etc., a wire rod for manufacturing such as fine steel wire, a method of manufacturing such a fine steel wire, a method of manufacturing the fine steel wire, and twisted products obtained by twisting the fine steel wires.

2. Description of the Prior Art

A fine steel wire used as a rubber reinforcing material is usually manufactured by the following procedures. First, a steel material having a specified chemical composition is hot-rolled and is, as required, subjected to controlled cooling. Subsequently, the obtained wire rod of 4.0 to 6.4 mm in diameter is subjected to primary drawing, patenting, secondary drawing, re patenting and plating, successively. Finally, the wire rod is wet-drawn into the fine steel wire. The fine steel wire thus obtained is used for a missile wire as it is, and for various kinds of products such as a steel cord formed by twisting a plurality of the fine steel wires.

In recent years, a fine steel wire having higher tensile strength has often used for a tire reinforcing steel cord to reduce the weight of tires, improve riding quality and enhance steering stability. For increasing the strength of the fine steel wire, there has been executed (1) a method of using a high carbon steel of an increased carbon content to increase the tensile strength of patented wire before final wire drawing or (2) a method of increasing the working strain generated upon wire drawing up to a finishing wire diameter as much as possible.

A carbon steel equivalent to JIS SWRS72A or SWRS82A has been used as a wire rod material for a steel tire cord. However, if the tensile strength of fine steel wire using the carbon steel described above is increased by increasing the working strain generated upon wire drawing up to the finishing wire diameter for satisfying the requirement described above, the toughness and ductility are remarkably degraded with increasing the strength, which leads to lowering of reduction of area or occurrence of delamination at the initial stage during a torsion test. Further, with respect to the carbon steel described above, if the tensile strength of patented wire is increased by merely increasing the carbon content, proeutectoid network cementites are deposited at the austenite grain boundaries, which also lead to degradation of toughness and ductility. As the toughness and ductility are degraded, breakages frequently occur during wet drawing for a fine wire of a steel tire cord or cabling, particularly, to remarkably lower the productivity.

Further, while the steel tire cord is manufactured by the steps as described above, if the carbon content is increased only for increasing the tensile strength, proeutectoid cementites are deposited at the prior austenite grain boundaries in the as-rolled wire rod and thereby breakages occur frequently, for example, in the primary wire drawing as an intermediate manufacturing step, to remarkably lower the productivity.

SUMMARY OF THE INVENTION

The present invention has been accomplished under the foregoing situation and an object thereof is to provide a fine steel wire having high tensile strength and high toughness used as a rubber reinforcing material for a belt cord, tire cord, etc., as a material for twisted wire products such as a miniature rope or as a missile wire, etc., a wire rod for manufacturing the fine steel wire, products using such fine steel wire, and a method of manufacturing the fine steel wire.

According to the present invention, there is provided a wire rod for a high tensile strength and high toughness fine steel wire, containing 0.85–1.2 wt % of C (preferably, 0.9 (not inclusive)–1.2 wt %), less than 0.45 wt % of Si, and 0.3–1.0 wt % of Mn, one or more of elements selected from the group consisting of 0.1–4.0 wt % of Ni and 0.05–4.0 wt % of Co, and if necessary, one or more of elements selected from the group consisting of 0.05–0.5 wt % of Cu, 0.05–0.5 wt % of Cr, 0.02–0.5 wt % of W, 0.05–0.5 wt % of V, 0.01–0.1 wt % of Nb, 0.05–0.1 wt % of Zr and 0.02–0.5 wt % of Mo, the balance being essentially Fe and inevitable impurities, wherein Al, N, P and S among the impurities are restricted as 0.005 wt % or less of Al, 0.005 wt % or less of N, 0.02 wt % or less of P and 0.015 wt % or less of S, and the average area ratio of the pro-eutectoid cementite in an as-rolled state or in a rolled and re-heat treated state is specified at 10 wt % or less. From the viewpoint of suppressing the breakage during drawing or cabling, it is preferred that the composition of non-metallic inclusions to the entire amount thereof is specified as described below.

(1) $Al_2O_3$: 20 wt % or less, MnO: 40% or less, $SiO_2$: 20 to 70 wt %, or (2) $Al_2O_3$: 20 wt % or less, CaO: 50 wt % or less, $SiO_2$: 20 to 70 wt %

A method of manufacturing a high tensile strength and high toughness fine steel wire according to the present invention has a feature that, when a wire rod satisfying various kinds of the composition requirements described above is drawn into a fine wire steel of 0.4mm or less in diameter, working strain is applied such that a reduction of total area upon wire drawing after the final patenting becomes 95% or more.

According to the method as described above, there can be obtained a high tensile strength and high toughness fine steel wire of 0.4 mm or less in diameter having the characteristics of a tensile strength (kgf/mm$^2$) not less than a value of $270-(130\times\log_{10}D)$ (D: wire diameter (mm)) and a reduction of area at tensile test not less than 35%. Further, by twisting the obtained fine steel wires, various kinds of products such as a steel cord or belt cord, or a miniature rope can be obtained.

DESCRIPTION OF THE PREFERRED EMBODIMENTS

Figure 1:
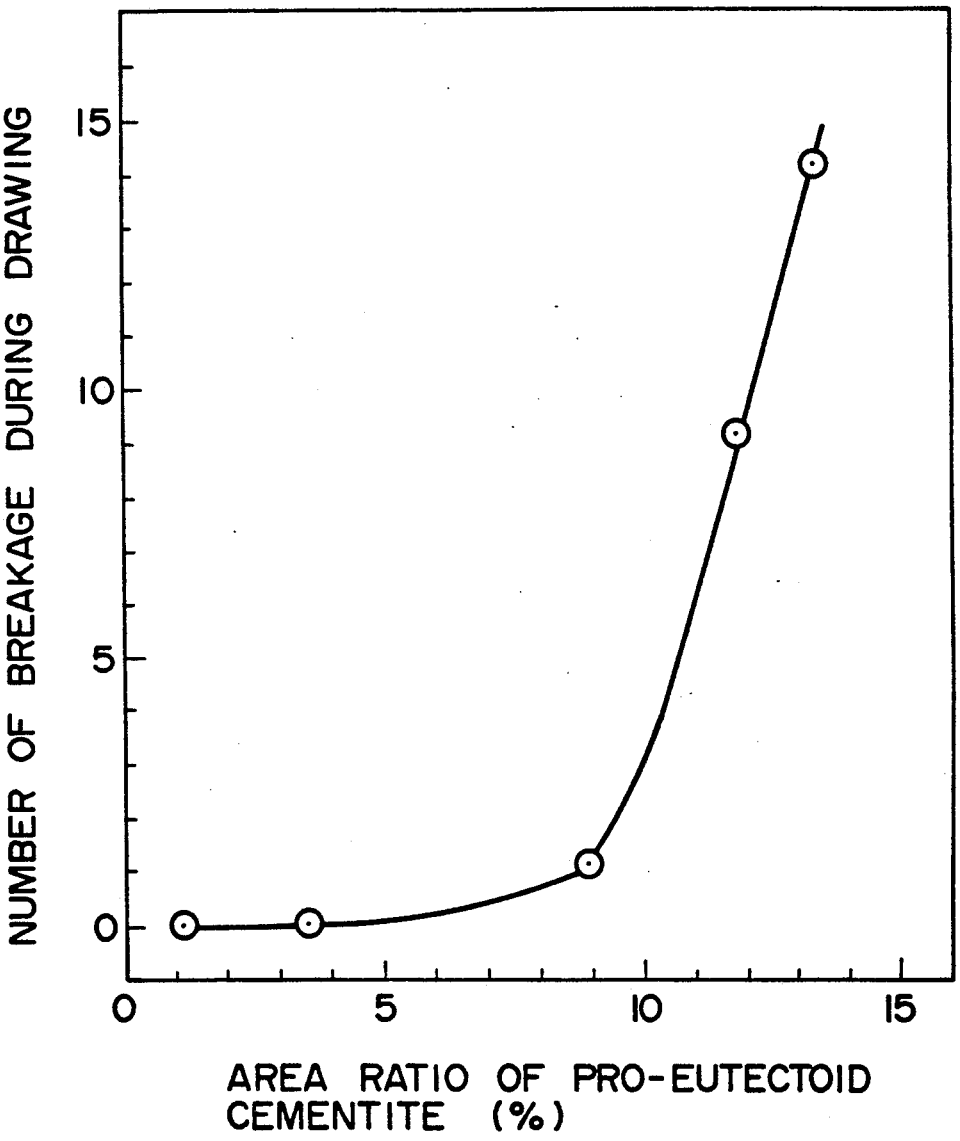
FIG. 1 is a graph illustrating a relationship between an area ratio of pro-eutectoid cementite in an as-rolled wire rod and a number of breakage during drawing.

As the raw material of a fine steel wire of 0.4 mm in diameter, the conventional high carbon steel wire rod (for example, JIS G 3506) or piano wire rod (for example, JIS G 3502) had the following problem. That is, when the total reduction of area upon wire drawing exceeds 95% and the tensile strength of the drawn wire becomes 320 kgf/mm$^2$ or more, a reduction of area at tensile test is remarkably lowered. The reduction of area at tensile test needs 35 wt % or more, because if it is lowered below 35 wt %, breakage frequently occurs in the final wet drawing or twisting. Further, in the conventional raw material, increasing of the strength causes inevitably delamination during a torsion test, which leads to frequent occurrence of breakage during twisting step and also occurrence of uneven lay length in the steel cord. Accordingly, increasing of the strength has to be restricted. Further, an as-rolled material of 5.5 mm in diameter, for example, is subjected to primary drawing up to about 3 mm in diameter and this causes such a problem that a great amount of pro-eutectoid cementites are deposited, in a case of hyper-eutectoid steel, at the prior austenite grain boundaries. Consequently, there frequently occur breakage to lower the productivity, or fine cracks remain in the steel although not leading to the breakage, which causes breakage upon secondary drawing or deterioration of the characteristics of the fine steel wire.

According to the study made by the present inventors, it has been found that a steel material having the composition and structure as defined in the present invention can ensure satisfactory toughness and ductility in the manufacturing step such as wire drawing. Specifically, the present steel material can ensure satisfactory ductility and toughness even in wire drawing up to a fine steel wire of 0.4 mm or less in diameter having a tensile strength not less than a value of $270-(130\times\log_{10}D)$ (D: wire diameter (mm)). Further, according to the result of an experiment for confirming the effect in a case where a reduction of area upon wire drawing is increased, it has been found that, in order to keep the tensile strength not less than the value defined by the formula described above, and the reduction of area after fracture not less than 35%, a total reduction of area in wire drawing after final patenting (final wire drawing step) may be specified at 95 wt % or more. Thus, the present invention has been accomplished. The reason for specifying each of the chemical components in the present invention is as shown below.

C: 0.85 to 1.2 wt %

As the C content is higher, the strength of a fine steel wire can be increased. However, by merely increasing the C content, pro-eutectoid cementites are deposited upon rolling or patenting, which causes frequent breakage, in particular, upon final drawing or twisting. This drawback can be suppressed by the addition effect of Co described later. However, when the C content is in excess of 1.2 wt %, segregation is remarkably increased to need the increased amount of Co to be added for performing rolling or patenting without existence of proeutectoid cementite thereby making the production cost higher, and further the amount of cementite relative to that of ferrite in the resultant pearlite structure is increased to deteriorate the toughness and ductility of the fine steel wire thereby causing frequent breakage. Accordingly, the C content has to be specified at 1.2 wt % or less. Meanwhile, when the C content is less than 0.85 wt %, the desired tensile strength for the fine wire steel can not be obtained. In addition, from the viewpoint of attaining a higher strength, it is preferred to specify the C content in excess of 0.9 wt %.

Si less than 0.45 wt %

Si is an effective element for strengthening ferrite in solid-solution and increasing the tensile strength of a patented material, and further for deoxidation. However, when Si is added by 0.45 wt % or more, formation of subscales is increased and the intergranular oxidation is increased to deteriorate the mechanical descalability for secondary scales.

Mn: 0.3 to 1 wt %

Mn is effective as a deoxidizing element in a melting step. Particularly, since the steel of the present invention is a low Si steel, Mn has to be added. Further, Mn has a function of fixing S in the steel as MnS and has an effect of preventing the degradation of the toughness and ductility of the steel wire rod caused by S solid-solubilized in the steel. For such effects, Mn has to be added by 0.3 wt % or more. Further, Mn is an important element for adjusting the composition of non-metallic inclusions causing breakage upon wet drawing or twisting into a composite composition having satisfactory ductility. For this purpose, addition of Mn in an appropriate amount is indispensable. On the other hand, since Mn is also an element of increasing the hardenability of steel and liable to be segregated, when the Mn content is in excess of 1.0 wt %, low temperature transformation phase such a martensite is generated in a segregation area to cause cuppy-like breakage.

Ni: 0.1 to 4 wt %

Ni is an element which is solid-solubilized into ferrite to effectively improve the toughness of the ferrite, but such an effect can not be obtained when the Ni content is less than 0.1 wt %. On the other hand, even if the Ni content is in excess of 4 wt %, the effect is saturated.

Co: 0.05 to 4 wt %

Co is effective for preventing the deposition of proeutectoid cementite and refining pearlite lamellae spacing. In order to obtain such an effect, Co has to be added by 0.05 wt % or more. However, even if the Co content is in excess of 4 wt %, the effect is saturated together with the increased cost.

The wire rod for the high strength and high toughness fine steel wire or the fine steel wire according to the present invention has the above-mentioned elements as the basic components and contains the balance of iron and inevitable impurities. Among the impurities, the content for each of Al, N, P and S has to be restricted as shown below.

Al: 0.005 wt % or less

Al is an effective element for deoxidizing upon melting and for preventing coarsening of the austenite grain size. However, when the Al content exceeds 0.005 wt %, a great amount of non-metallic inclusions such as $Al_2O_3$ or $MgO\text{-}Al_2O_3$ system are formed to cause disconnections upon wet drawing or twisting. Further, such non-metallic inclusions not only shorten the service life of dies in the final wet drawing but also deteriorate the fatigue characteristics of the steel cord or the filament thereof. Accordingly, it is preferred in the present steel to reduce the amount of Al as low as possible, i.e., at least to 0.005 wt % or less (inclusive 0) and, preferably, to 0.003 wt % or less.

N: 0.005 wt % or less

When the N content is in excess of 0.005 wt %, N gives an undesirable effect on the toughness and ductility by strain aging. Therefore, it is necessary to restrict the N content to 0.005 wt % or less.

P: 0.02 wt % or less

Like S, P is an element which reduces the toughness and ductility of the steel and which is liable to be segregated. Accordingly, it is necessary in the present invention to restrict the P content to 0.02 wt % or less, preferably, to 0.015 wt % or less.

S: 0.015 wt % or less

As described above, S is an element which reduces the toughness and ductility of the steel and which is liable to be segregated. Accordingly, it is necessary in the present invention to restrict the S content to 0.015 wt % or less, preferably, to 0.001 wt % or less.

The wire rod for a high strength and high toughness fine steel wire or the fine steel wire according to the present invention may contain one or more of elements selected from the group consisting of Cu, Cr, W, V, Nb, Z and Mo, as required. The respective contents of the above-mentioned elements and the reason for specifying the respective contents are as shown below.

Cu: 0.05 to 0.5 wt %

Like Cr described later, Cu is an effective element for improving the corrosion resistance. For this purpose, Cu has to be added by 0.05 wt % or more. However, when the Cu content is in excess of 0.5 wt %, Cu is segregated at the grain boundaries to promote occurrence of cracks or flaws upon steel ingot blooming or wire rod hot rolling.

Cr: 0.05 to 0.5 wt %

Cr has an effect of improving the corrosion resistance of the steel. Further, since Cr has an effect of increasing the rate of work hardening during wire drawing, a high strength can be obtained even at a relatively low working ratio by the addition of Cr. In order to attain such an effect, it is necessary to add Cr by 0.05 wt % or more. However, when the Cr content is in excess, Cr increases the hardenability to the pearlite transformation thereby making the patenting treatment difficult, and further renders the secondary scale descalability or pickling descalability. Accordingly, it is necessary to restrict the Cr content to 0.5 wt % or less.

W: 0.02 to 0.5 wt %

W is an effective element for improving the corrosion resistance. When the W content is less than 0.02 wt %, such an effect can not be attained. On the other hand, when the N content is in excess of 0.5 wt %, the effect is saturated.

V: 0.05 to 0.5 wt %; Nb: 0.01 to 0.1 wt %; Zr: 0.05 to 0.1 wt %

V, Nb, Zr are effective elements for refining the austenite grain size upon patenting to improve the toughness and ductility of the fine steel wire. In order to attain this effect, it is necessary to add each of V and Zr by 0.05 wt % or more and Nb by 0.01 wt % or more. However, the effect is substantially saturated when the addition amount is 0.5 wt % for V and 0.1 wt % for each of Nb and Zr.

Mo: 0.02 to 0.5 wt %

Mo is an effective element for suppressing the segregation of P at the grain boundaries to improve the toughness of the fine steel wire. In order to attain this effect, it has to be added by 0.02 wt % or more. Meanwhile, when the Mo content is in excess of 0.5 wt %, a long time will be necessary for the pearlite transformation during patenting, thereby making the cost higher.

In addition to the above-mentioned components, REM such as Ca, La and Ce may be added as required.

From the viewpoint of suppressing breakage during wire drawing and wire twisting, it is preferred that the composition of the non-metallic inclusions to the entire amount thereof is specified as described below.

(1) $Al_2O_3$: 20 wt % or less, MnO: 40% or less, $SiO_2$: 20 to 70 wt % (if necessary, MgO: 15 wt % or less)

(2) $Al_2O_3$: 20 wt % or less, CaO: 50 wt % or less, $SiO_2$: 20 to 70 wt % (if necessary, MgO: 15 wt % or less)

Further, in a case of applying the present fine steel wire to a steel cord, the fine steel wire can contribute to the reduction of the weight when it is applied not only to a steel cord having the known twisting construction as described in, for example, Japanese Patent Laid-Open Sho 57-193253, Sho 55-90692, Sho 62-222910, U.S. Pat. No. 4,627,229 and 4,258,543 and Japanese Utility Model Laid-Open Sho 58-92395 but also to a steel cord having a new twisting construction.

EXAMPLE

The present invention will now be described more specifically by way of its examples but the following examples do not restrict the present invention and any design modification within the gist described above and below is included within the technical range of the present invention.

EXAMPLE 1

Table 1 shows chemical compositions of test steels (Nos. 1–18) melted in a vacuum melting furnace.

150 kg of a steel ingot melted under vacuum was hot-forged into billets each of 115×115 (mm), which were hot-rolled into wire rods each of 5.5 mm in diameter while controlling the rolling temperature and cooling rate. The cross sectional structure of each wire rod was observed and the area ratio of the pro-eutectoid cementites deposited at the prior austenite grain boundaries was measured by an image analyzer. The results are also shown in Table 1.

These wire rods were drawn into 2.65 mm in diameter, and the number of breakage during wire drawing was measured. FIG. 1 shows a relationship between an area ratio of the pro-eutectoid cementite of the as-rolled material and a number of breakage of the wire rod. As apparent from FIG. 1, breakage during wire drawing can be suppressed extremely by reducing the area ratio of the pro-eutectoid cementite to 10 wt % or less.

The obtained steel wires were subjected to lead patenting and then drawn into 1.3 mm in diameter. The resultant steel wires were further subjected to lead patenting and plating and then wet-drawn into fine steel wires each of 0.2 mm in diameter (total reduction of area: 97.6%). Table 2 shows the characteristics of the resultant fine steel wire (tensile strength, reduction of area, absence or presence of delamination during torsion test). As apparent from Table 2, the wire rod according to the present invention is excellent in the toughness and ductility, and the fine steel wire having high strength and high toughness can be obtained.

Then, test steel Nos. 1, 10 and 18 were drawn into 0.2 mm in diameter and a relationship between a number of breakage during wire drawing and a composition of non-metallic inclusions was investigated, which gave the result shown in Table 3. As apparent from Table 3, breakage during wire drawing can be minimized by properly controlling the composition of the non-metallic inclusions.

Further, test steel Nos. 1 and 16, with final patenting diameters specified at 1.0 mm and 0.85 mm (only 0.85 mm for the test steel No.16), were wet-drawn into fine steel wires each of 0.2 mm in diameter, and a relationship between a total reduction of area during wire drawing and characteristics of the fine steel wires after the final patenting (tensile strength, reduction of area) was investigated. The results are shown in Table 4 as compared to a case with the final patenting diameter specified at 1.3 mm (results shown in Table 2). As apparent from Table 4, fine steel wires of high strength and high toughness can be obtained by increasing the total reduction of area in final drawing up to 95% or more.

Figure 2:
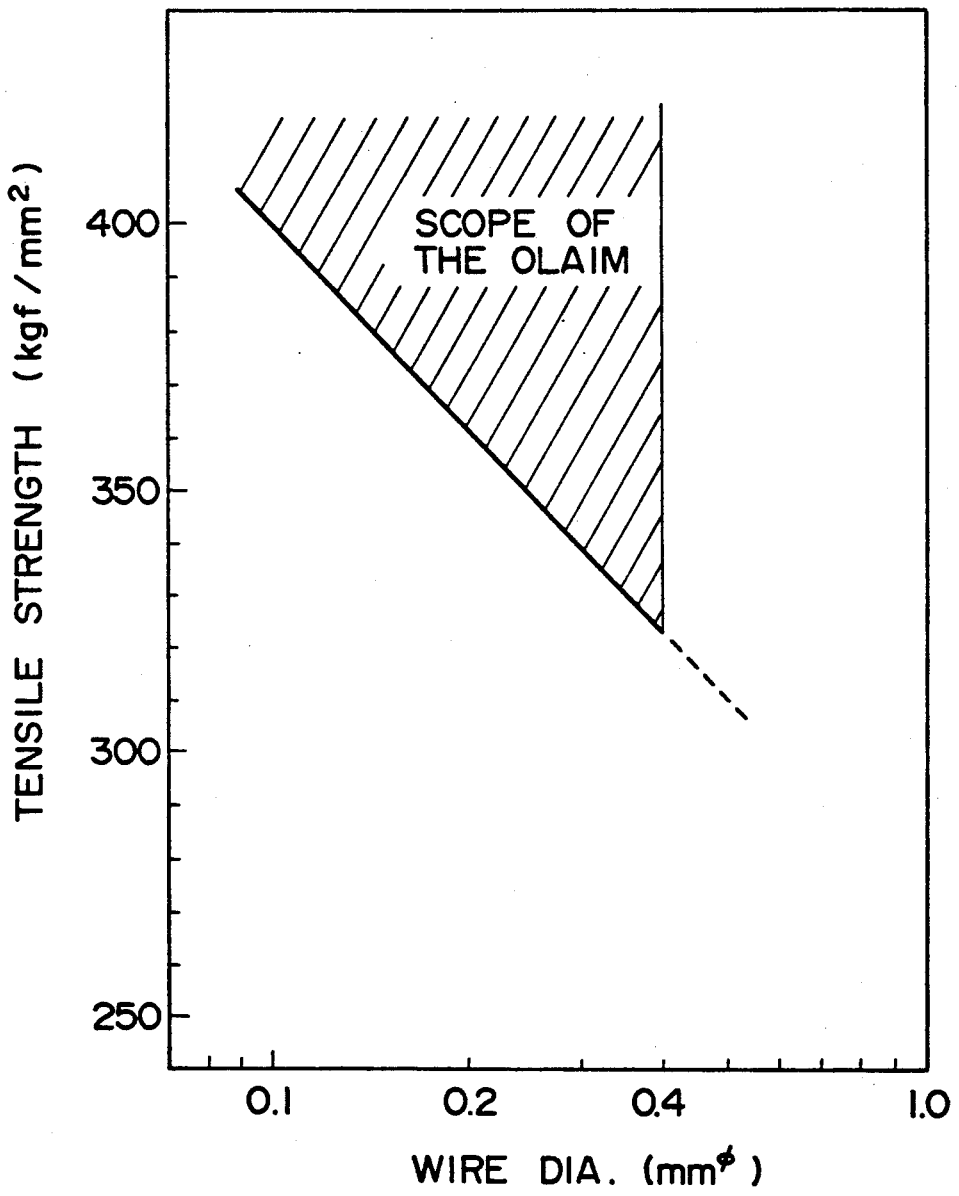
FIG. 2 is a graph illustrating a relationship between a wire diameter and a tensile strength of a fine steel wire.

For the fine steel wires according to the present invention, a relationship between a wire diameter and a tensile strength was investigated, which gave the results shown in FIG. 2. As apparent from FIG. 2, the fine steel wires according to the present invention exhibits extremely high strength.

TABLE 1

| Test steel No. | Chemical composition (wt %) C | Si | Mn | P | S | Al | Ni | Co | others | Area ratio of pro-eutectoid cementite of rolled material (%) |
|---|---|---|---|---|---|---|---|---|---|---|
| 1 | 1.03 | 0.20 | 0.53 | 0.006 | 0.003 | 0.002 | 0.48 | 0.58 | — | 1.1 |
| 2 | 1.03 | 0.20 | 0.53 | 0.006 | 0.003 | 0.002 | 0.48 | 0.58 | — | 3.5 |
| 3 | 1.03 | 0.20 | 0.53 | 0.006 | 0.003 | 0.002 | 0.48 | 0.58 | — | 8.9 |
| 4 | 1.03 | 0.20 | 0.53 | 0.006 | 0.003 | 0.002 | 0.48 | 0.58 | — | 11.8 |
| 5 | 1.03 | 0.20 | 0.53 | 0.006 | 0.003 | 0.002 | 0.48 | 0.58 | — | 13.3 |
| 6 | 1.03 | 0.20 | 0.52 | 0.006 | 0.004 | 0.002 | — | — | — | 7.8 |
| 7 | 1.03 | 0.20 | 0.52 | 0.006 | 0.004 | 0.002 | — | — | — | 16.9 |
| 8 | 1.01 | 0.18 | 0.49 | 0.027 | 0.002 | 0.001 | 0.49 | 0.51 | — | 2.1 |
| 9 | 1.01 | 0.17 | 0.52 | 0.007 | 0.018 | 0.001 | 0.47 | 0.49 | — | 2.3 |
| 10 | 1.01 | 0.22 | 0.51 | 0.006 | 0.002 | 0.011 | 0.51 | 0.52 | — | 2.8 |
| 11 | 1.00 | 0.18 | 0.50 | 0.005 | 0.003 | 0.001 | 0.53 | 0.56 | Cr: 0.15 | 0.5 |
| 12 | 1.01 | 0.23 | 0.48 | 0.006 | 0.003 | 0.002 | 0.52 | 0.55 | Cu: 0.23 | 1.0 |
| 13 | 1.02 | 0.22 | 0.51 | 0.006 | 0.002 | 0.002 | 0.51 | 0.52 | V: 0.16 | 3.7 |
| 14 | 1.01 | 0.22 | 0.49 | 0.005 | 0.002 | 0.002 | 0.50 | 0.51 | Nb: 0.06 | 4.3 |
| 15 | 1.01 | 0.23 | 0.51 | 0.006 | 0.002 | 0.002 | 0.49 | 0.53 | Zr: 0.09 | 3.8 |
| 16 | 1.02 | 0.22 | 0.50 | 0.006 | 0.003 | 0.002 | 0.51 | 0.48 | Mo: 0.08 | 0.4 |
| 17 | 1.00 | 0.25 | 0.46 | 0.004 | 0.002 | 0.002 | 0.48 | 0.53 | W: 0.13 | 1.2 |
| 18 | 1.01 | 0.18 | 0.52 | 0.005 | 0.004 | 0.002 | 0.49 | 0.54 | — | 2.9 |

TABLE 2

| Test steel No. | Number of breakage in 2.65 mm dia. | Characteristics for fine steel wire of 0.2 mm dia. Tensile strength (kgf/mm²) | Reduction of area (%) | Absence or presence of delamination during torsion test | Remarks |
|---|---|---|---|---|---|
| 1 | 0 | 391 | 46 | Absence | Example |
| 2 | 0 | 389 | — | — | " |
| 3 | 1 | 392 | — | — | Comp. example |
| 4 | 9 | (not practiced) | | | Comp. example |
| 5 | 14 | (not practiced) | | | Comp. example |
| 6 | 1 | 383 | 23 | Presence | Comp. example |
| 7 | 17 | (not practiced) | | | Comp. example |
| 8 | 0 | 393 | 21 | Presence | Comp. example |
| 9 | 0 | 392 | 30 | Presence | Comp. example |
| 10 | 0 | 389 | 32 | Presence | Comp. example |
| 11 | 0 | 398 | 41 | Absence | Example |
| 12 | 0 | 392 | 45 | Absence | " |

TABLE 2-continued

| Test steel No. | Number of breakage in 2.65 mm dia. | Characteristics for fine steel wire of 0.2 mm dia. Tensile strength (kgf/mm²) | Reduction of area (%) | Absence or presence of delamination during torsion test | Remarks |
|---|---|---|---|---|---|
| 13 | 0 | 403 | 42 | Absence | " |
| 14 | 0 | 391 | 47 | Absence | " |
| 15 | 0 | 398 | 46 | Absence | " |
| 16 | 0 | 408 | 41 | Absence | " |
| 17 | 0 | 399 | 42 | Absence | " |
| 18 | 0 | 386 | 43 | Absence | " |

TABLE 3

| Test steel No. | Composition of non-metallic inclusions $Al_2O_3$ (wt %) | CaO (wt %) | $SiO_2$ (wt %) | Number of breakage in 0.2 mm dia. |
|---|---|---|---|---|
| 1 | 15 | 28 | 57 | 1 |
| 10 | 88 | 4 | 8 | 18 |
| 18 | 25 | 20 | 55 | 11 |

TABLE 4

| Test steel No. | Wire dia. of final patenting material (mm) | Dia. of fine steel wire (mm) | Total reduction in final wire drawing step (%) | Characteristics of fine steel wire Tensile strength (kgf/mm²) | reduction of area (%) | Remarks |
|---|---|---|---|---|---|---|
| 1 | 1.3 | 0.2 | 97.6 | 391 | 46 | Example |
| | 1.0 | 0.2 | 96.0 | 366 | 48 | Example |
| | 0.85 | 0.2 | 94.7 | 344 | 47 | Comp. example |
| 16 | 1.3 | 0.2 | 97.6 | 408 | 41 | Example |
| | 0.85 | 0.2 | 94.7 | 355 | 45 | Comp. example |

EXAMPLE 2

Table 5 shows chemical compositions of test steels Nos. 19–39 melted in a vacuum melting furnace.

150 kg of a steel ingot melted under vacuum was hot-forged into billets each of 115×115 (mm), which were hot-rolled into wire rods each of 5.5 mm in diameter. The area ratio of the pro-eutectoid cementite measured for the wire rods in the same way as in Example 1 is also shown in Table 1.

The obtained wire rods were repeatedly subjected to heat treatment and wire drawing into 1.75 mm in diameter, and were then subjected to patenting and further wet-drawn into fine steel wires each of 0.25 mm or 0.3 mm in diameter. Table 6 shows characteristics of the resultant fine steel wires (tensile strength, reduction of area, absence or presence of delamination during torsion test), together with a wire diameter and a reduction of area. As apparent from Table 6, the fine wire rods according to the present invention can attain high strength and high toughness.

Figure 3:
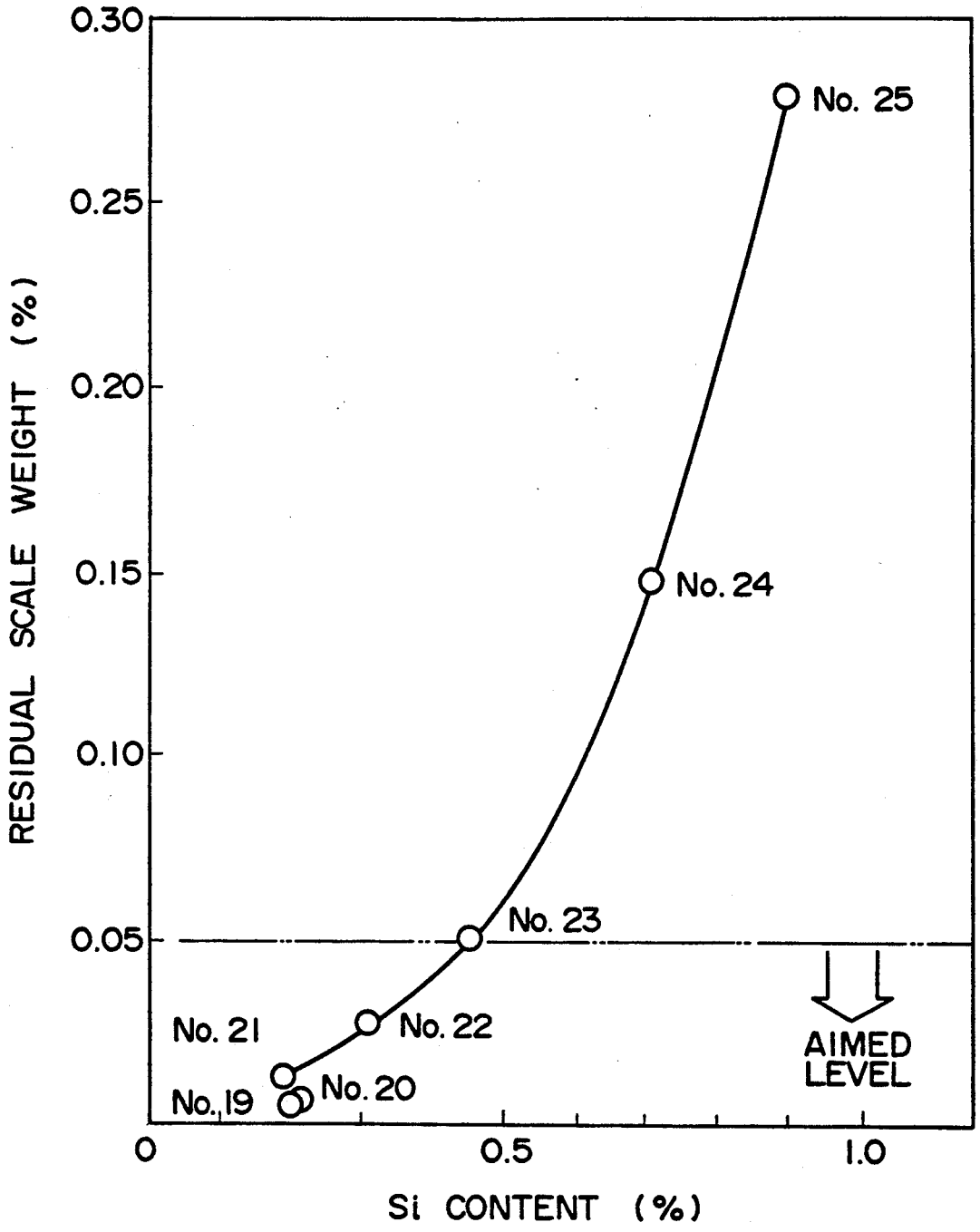
FIG. 3 is a graph illustrating a relationship between a Si content and an amount of residual scale.
Figure 4:
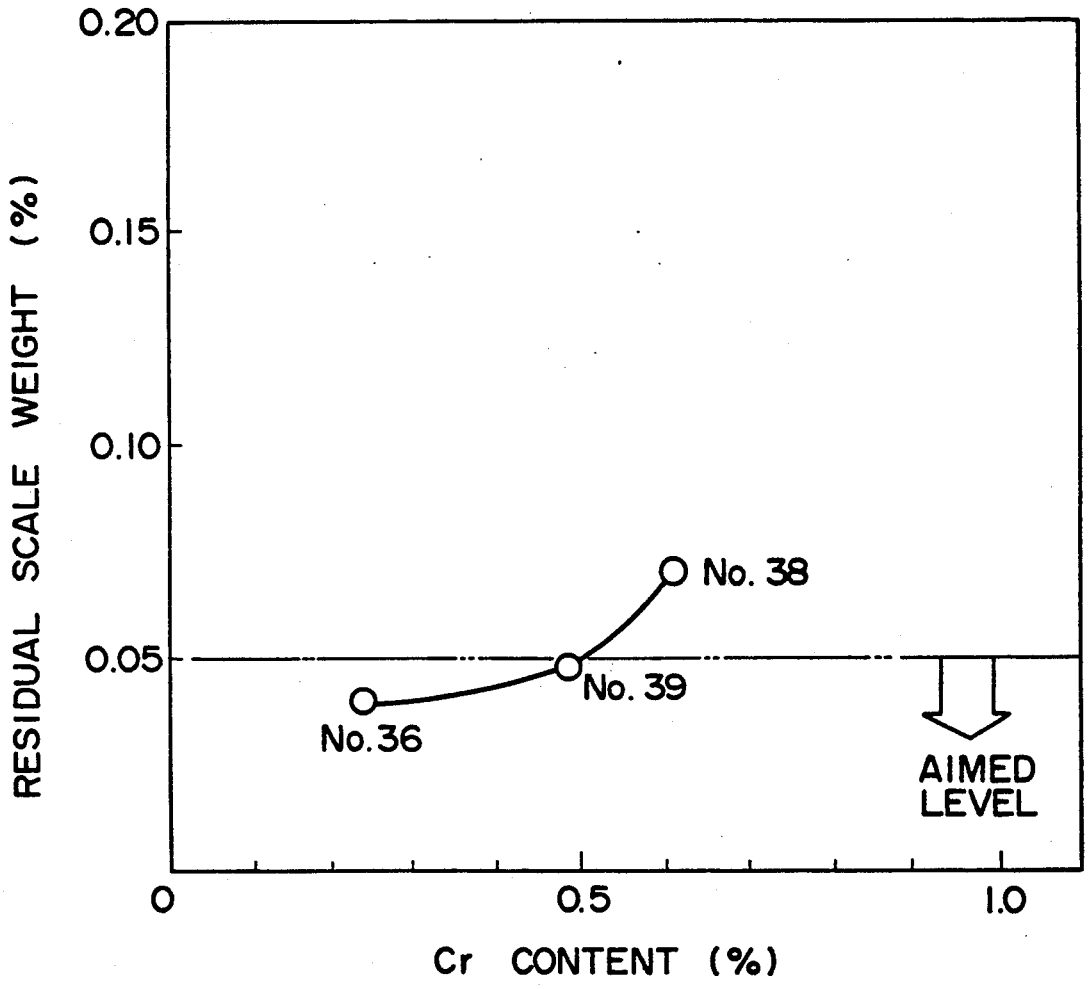
FIG. 4 is a graph illustrating a relationship between a Cr content and an amount of residual scale.

On the other hand, the present inventors evaluated the descalability of secondary scales based on an amount of residual scale after a mechanical descaling test conducted for hot-rolled wire rods. FIG. 3 shows a relationship between a Si content and an amount of the residual scales, and FIG. 4 shows a relationship between a Cr content and an amount of residual scale. From the results, it can be seen that the fine wire rod according to the present invention also has satisfactory descalability of the secondary scales.

TABLE 5

| Test steel No. | Chemical composition (wt %) C | Si | Mn | P | S | Al | Co | N | others | Area ratio of pro-eutectoid cementite of rolled material (%) |
|---|---|---|---|---|---|---|---|---|---|---|
| 19 | 0.82 | 0.22 | 0.49 | 0.009 | 0.002 | 0.001 | — | 0.0029 | — | 0.5 |
| 20 | 1.01 | 0.21 | 0.48 | 0.008 | 0.003 | 0.001 | — | 0.0031 | — | 8.2 |
| 21 | 1.02 | 0.19 | 0.45 | 0.007 | 0.004 | 0.002 | 0.48 | 0.0029 | — | 5.1 |
| 22 | 1.00 | 0.31 | 0.47 | 0.008 | 0.002 | 0.001 | 0.46 | 0.0033 | — | 3.9 |
| 23 | 1.02 | 0.44 | 0.46 | 0.006 | 0.005 | 0.002 | 0.45 | 0.0032 | — | 2.7 |
| 24 | 1.01 | 0.71 | 0.48 | 0.008 | 0.003 | 0.001 | 0.48 | 0.0028 | — | 2.1 |
| 25 | 1.00 | 0.90 | 0.51 | 0.006 | 0.002 | 0.002 | 0.49 | 0.0029 | — | 0.9 |
| 26 | 1.00 | 0.24 | 0.53 | 0.025 | 0.003 | 0.001 | 0.51 | 0.0024 | — | 4.6 |
| 27 | 1.02 | 0.21 | 0.47 | 0.005 | 0.019 | 0.001 | 0.49 | 0.0026 | — | 3.9 |
| 28 | 1.01 | 0.19 | 0.50 | 0.003 | 0.006 | 0.008 | 0.52 | 0.0027 | — | 4.8 |
| 29 | 1.02 | 0.22 | 0.48 | 0.008 | 0.007 | 0.001 | 0.49 | 0.0066 | — | 5.1 |
| 30 | 0.99 | 0.28 | 0.51 | 0.009 | 0.003 | 0.001 | 0.53 | 0.0029 | Cu: 0.21 | 3.2 |
| 31 | 0.98 | 0.31 | 0.46 | 0.008 | 0.003 | 0.001 | 0.46 | 0.0029 | N: 0.15 | 4.1 |
| 32 | 0.99 | 0.23 | 0.50 | 0.007 | 0.004 | 0.002 | 0.46 | 0.0033 | Nb: 0.05 | 5.4 |
| 33 | 1.00 | 0.24 | 0.49 | 0.008 | 0.005 | 0.001 | 0.48 | 0.0030 | Zr: 0.11 | 4.7 |
| 34 | 0.92 | 0.28 | 0.53 | 0.007 | 0.004 | 0.001 | 0.41 | 0.0029 | — | 2.2 |
| 35 | 0.92 | 0.26 | 0.51 | 0.008 | 0.005 | 0.002 | — | 0.0027 | — | 7.1 |
| 36 | 0.93 | 0.21 | 0.46 | 0.009 | 0.003 | 0.001 | 0.39 | 0.0022 | Cr: 0.24 | 1.6 |
| 37 | 0.91 | 0.19 | 0.45 | 0.007 | 0.003 | 0.002 | 0.41 | 0.0031 | Mo: 0.16 | 1.1 |
| 38 | 0.91 | 0.22 | 0.46 | 0.008 | 0.004 | 0.001 | 0.44 | 0.0030 | Cr: 0.61 | 1.0 |
| 39 | 0.92 | 0.17 | 0.44 | 0.006 | 0.003 | 0.002 | 0.41 | 0.0032 | Cr: 0.49 | 1.2 |

TABLE 6

| Test steel No. | Wire dia. (mm ϕ) | Reduction of area (%) | Tensile strength (kgf/mm²) | Reduction of area (%) | Absence or presence of delamination during torsion test | Remarks |
|---|---|---|---|---|---|---|
| 19 | 0.3 | 97.1 | 313 | 47 | Absence | Comp. example |
| 20 | 0.25 | 98.0 | 387 | 29 | Presence | Comp. example |
| 21 | " | " | 388 | 44 | Absence | Example |
| 22 | " | " | 391 | 41 | " | " |
| 23 | " | " | 393 | 42 | " | " |
| 24 | " | " | 394 | 43 | " | Comp. example |
| 25 | " | " | 398 | 39 | " | Comp. example |
| 26 | " | " | 394 | 32 | Presence | Comp. example |
| 27 | " | " | 393 | 33 | " | Comp. example |
| 28 | " | " | 391 | 34 | " | Comp. example |
| 29 | " | " | 389 | 22 | " | Comp. example |
| 30 | " | " | 387 | 45 | Absence | Example |
| 31 | " | " | 398 | 46 | " | " |
| 32 | " | " | 398 | 47 | " | " |
| 33 | " | " | 398 | 44 | " | " |
| 34 | 0.3 | 97.1 | 367 | 48 | " | " |
| 35 | " | " | 363 | 31 | Presence | Comp. example |
| 36 | " | " | 375 | 43 | Absence | Example |
| 37 | " | " | 371 | 45 | " | " |
| 38 | " | " | 383 | 21 | Presence | Comp. example |
| 39 | " | " | 377 | 36 | Absence | Example |

EXAMPLE 3

Table 7 shows chemical compositions of test steel Nos. 40–59 melted in a vacuum melting furnace.

150 kg of a steel ingot melted under vacuum was hot-forged into billets, which were hot-rolled into wire rods each of 5.5 mm in diameter while controlling the rolling temperature and the cooling rate. The structures of the wire rods were observed and the area ratio of the pro-eutectoid cementites deposited at the prior austenite grain boundaries were measured by an image analyzer. The results are also shown in Table 7.

The obtained wire rods were drawn into 2.65 mm in diameter, and the number of breakage during wire drawing was measured. The results are shown in Table 8. The resultant steel wires were subjected to lead patenting and drawn into 1.3 mm in diameter. The steel wires were further subjected to lead patenting and plating and then wet-drawn into fine steel wires each of 0.2 mm in diameter (total reduction of area: 97.6%). Table 8 also shows characteristics of the resultant fine steel wires (tensile strength, reduction of area after fracture, absence or presence of delamination during torsion test). As apparent from Table 8, the wire rods according to the present invention are excellent in the toughness and ductility, and fine steel wires having high strength and high toughness can be obtained.

Then, test steel Nos. 41, 57 and 59 were drawn into 0.2 mm in diameter and a relationship between a number of breakage during wire drawing and a composition of non-metallic inclusions was investigated, which gave the results shown in Table 9. As apparent from Table 9, breakage during the wire drawing can be minimized by properly controlling the composition of the non-metallic inclusions.

TABLE 7

| Test steel No. | Chemical composition (wt %) C | Si | Mn | P | S | Al | Ni | others | Area ratio of pro-eutectoid cementite of rolled material (%) |
|---|---|---|---|---|---|---|---|---|---|
| 40 | 0.82 | 0.21 | 0.48 | 0.009 | 0.002 | 0.001 | | — | 0.9 |
| 41 | 1.02 | 0.21 | 0.53 | 0.006 | 0.002 | 0.002 | 0.52 | — | 1.1 |
| 42 | 1.02 | 0.21 | 0.53 | 0.006 | 0.002 | 0.002 | 0.52 | — | 3.7 |
| 43 | 1.02 | 0.21 | 0.53 | 0.006 | 0.002 | 0.002 | 0.52 | — | 5.6 |
| 44 | 1.02 | 0.21 | 0.53 | 0.006 | 0.002 | 0.002 | 0.52 | — | 9.3 |
| 45 | 1.02 | 0.21 | 0.53 | 0.006 | 0.002 | 0.002 | 0.52 | — | 12.1 |
| 46 | 1.02 | 0.21 | 0.53 | 0.006 | 0.002 | 0.002 | 0.52 | — | 14.6 |
| 47 | 1.02 | 0.21 | 0.53 | 0.006 | 0.002 | 0.002 | 0.52 | — | 19.2 |
| 48 | 1.02 | 0.19 | 0.49 | 0.007 | 0.003 | 0.002 | 0.49 | Cr: 0.23 | 1.3 |
| 49 | 1.01 | 0.19 | 0.51 | 0.006 | 0.002 | 0.001 | 0.51 | Cu: 0.26 | 1.4 |
| 50 | 1.02 | 0.21 | 0.52 | 0.005 | 0.003 | 0.001 | 0.51 | V: 0.15 | 1.1 |
| 51 | 1.01 | 0.20 | 0.51 | 0.006 | 0.003 | 0.002 | 0.50 | Nb: 0.05 | 0.9 |
| 52 | 1.02 | 0.21 | 0.49 | 0.007 | 0.004 | 0.002 | 0.49 | Zr: 0.08 | 1.3 |
| 53 | 1.01 | 0.22 | 0.51 | 0.006 | 0.003 | 0.002 | 0.53 | Mo: 0.11 | 1.1 |
| 54 | 1.01 | 0.19 | 0.48 | 0.006 | 0.003 | 0.002 | 0.51 | W: 0.14 | 1.3 |
| 55 | 1.02 | 0.21 | 0.50 | 0.028 | 0.003 | 0.002 | 0.51 | — | 1.0 |
| 56 | 1.02 | 0.21 | 0.51 | 0.006 | 0.019 | 0.002 | 0.49 | — | 1.2 |
| 57 | 1.02 | 0.19 | 0.52 | 0.006 | 0.003 | 0.014 | 0.52 | — | 0.9 |
| 58 | 1.02 | 0.20 | 0.51 | 0.005 | 0.003 | 0.002 | 0.51 | N: 0.0070 | 1.1 |
| 59 | 1.02 | 0.21 | 0.51 | 0.006 | 0.002 | 0.002 | 0.52 | — | 1.4 |

(Note) The content of N in test steel Nos. 40–57, 49: 0.0028 to 0.0041

TABLE 8

| Test steel No. | Number of breakage in 2.65 mm dia. | Characteristics for fine steel wire of 0.2 mm dia. Tensile strength (kgf/mm$^2$) | Reduction of area (%) | Absence or presence of delamination during torsion test | Remarks |
|---|---|---|---|---|---|
| 40 | 0 | 340.8 | 46 | Absence | Comp. example |
| 41 | 0 | 396.7 | 44 | Absence | Example |
| 42 | 0 | 395.8 | 43 | Absence | Example |
| 43 | 1 | 396.9 | 42 | Absence | Example |
| 44 | 2 | 398.1 | 42 | Absence | Example |
| 45 | 11 | | (not practiced) | | Comp. example |
| 46 | 16 | | (not practiced) | | Comp. example |
| 47 | 20 | | (not practiced) | | Comp. example |
| 48 | 0 | 411.5 | 39 | Absence | Example |
| 49 | 0 | 399.1 | 41 | Absence | Example |
| 50 | 0 | 401.4 | 43 | Absence | Example |
| 51 | 0 | 391.1 | 43 | Absence | Example |
| 52 | 0 | 391.6 | 45 | Absence | Example |
| 53 | 0 | 408.7 | 43 | Absence | Example |
| 54 | 0 | 401.5 | 43 | Absence | Example |
| 55 | 0 | 398.2 | 29 | Presence | Comp. example |
| 56 | 0 | 396.3 | 23 | Presence | Comp. example |
| 57 | 0 | 398.0 | 25 | Presence | Comp. example |
| 58 | 0 | 410.8 | 21 | Presence | Comp. example |

TABLE 9

| Test steel No. | Composition of non-metallic inclusions $Al_2O_3$ (wt %) | CaO (wt) | $SiO_2$ (wt %) | Number of breakage in 0.2 mm dia. |
|---|---|---|---|---|
| 41 | 16 | 31 | 53 | 1 |
| 57 | 86 | 4 | 10 | 21 |
| 59 | 26 | 22 | 52 | 13 |

What is claimed is:

1. A wire rod for a high strength and high toughness fine steel wire, containing 0.85–1.2 wt % of C, less than 0.45 wt % of Si, and 0.3–1.0 wt % of Mn, one or more of elements selected from the group consisting of 0.1–4.0 wt % of Ni and 0.05–4.0 wt % of Co, the balance being essentially Fe and inevitable impurities, wherein Al, N, P and S among the impurities are restricted as 0.005 wt % or less of Al, 0.005 wt % or less of N, 0.02 wt % or less of P and 0.015 wt % or less of S, and the average area ratio of the pro-eutectoid cementite in an as-rolled state or in a rolled and re-heat treated state is specified at 10 wt % or less.

2. The wire rod for a high strength and high toughness fine steel wire as defined in claim 1, further containing one or more of elements selected from the group consisting of 0.05–0.5 wt % of Cu, 0.05–0.5 wt % of Cr and 0.02–0.5 wt % of W.

3. The wire rod for a high strength and high toughness fine steel wire as defined in claim 1, further containing one or more of elements selected from the group consisting of 0.05–0.5 wt % of V, 0.01–0.1 wt % of Nb, 0.05–0.1 wt % of Zr and 0.02–0.5 wt % of Mo.

4. The wire rod for a high strength and high toughness fine steel wire as defined in claim 1, further containing one or more of elements selected from the group consisting of 0.05–0.5 wt % of Cu, 0.05–0.5 wt % of Cr, 0.02–0.5 wt % of W, and one or more of elements selected from the group consisting of 0.05–0.5 wt % of V, 0.01–0.1 wt % of Nb, 0.05–0.1 wt % of Zr and 0.02–0.5 wt % of Mo.

5. The wire rod for a high strength and high toughness fine steel wire as defined in any one of claim 1, wherein the composition of non-metallic inclusions to the entire amount thereof is specified as, (a) $Al_2O_3$: 20 wt % or less, MnO: 40% or less, $SiO_2$: 20 to 70 wt %, or (b) $Al_2O_3$: 20 wt % or less, CaO: 50 wt % or less, $SiO_2$: 20 to 70 wt %.

6. A method of manufacturing a high strength and high toughness fine steel wire, which comprise drawing a wire rod into a fine wire steel of 0.4 mm or less in diameter, and applying a working strain thereto such that reduction of total area upon the wire drawing after final patenting becomes 95% or more, and wherein said wire rod contains 0.85–1.2 wt % of C, less than 0.45 wt. % of Si, and 0.3–1.0 wt % of Mn, one or more elements selected from the group consisting of 0.1–4.0 wt. % of Ni and 0.05–4.0 wt. % of Co, the balance being essentially Fe and inevitable impurities, wherein Al, N, P and S among the impurities are restricted as 0.005 wt. % or less of Al, 0.005 wt. % or less of N, 0.02 wt. % or less of P and 0.015 wt. % or less of S, and having an average area ratio of proeutectoid cementite in an as-rolled state or in a rolled and re-heat treated state of 10 wt. % or less.

7. The method of claim 6, wherein said wire rod further contains one or more elements selected from the group consisting of 0.05–0.5 wt % of Cu, 0.05–0.5 wt T of Cr and 0.02–0.5 wt % of W.

8. The method of claim 6, wherein said wire rod further contains one or more elements selected from the group consisting of 0.05–0.5 wt % of V, 0.01–0.1 wt % of Nb, 0.05–0.1 wt % of Zr and 0.02–0.5 wt T of Mo.

9. The method of claim 6, wherein the wire rod further contains non-metallic inclusions in the amount of:

(a) $Al_2O_3$: 20 wt. % or less, MnO: 40% or less, $SiO_2$: 20–70 wt. %, or (b) $Al_2O_3$: 20 wt. % or less, CaO: 50 wt. % or less, $SiO_2$: 20–70 wt. %.

10. A high strength and high toughness fine steel wire having a diameter of 0.4 mm or less manufactured by said method as defined in claim 6, wherein said fine steel wire has a tensile strength ($kgf/mm^2$) not less than a value of $270-(130\times\log_{10} D)$ (D: wire diameter (mm)) and a reduction of area not less than 35%.

11. A high strength and high toughness fine steel wire having a diameter of 0.4 mm or less manufactured by said method as defined in claim 7, wherein said fine steel wire has a tensile strength ($kgf/mm^2$) not less than a value of $270-(130\times\log_{10} D)$ (D: wire diameter (mm)) and a reduction of area not less than 35%.

12. A twisted product made by twisting said fine steel wires as defined in claim 10.

13. A twisted product made by twisting said fine steel wires as defined in claim 11.

* * * * *

UNITED STATES PATENT AND TRADEMARK OFFICE
CERTIFICATE OF CORRECTION

PATENT NO. : 5,211,772

DATED : May 18, 1993

INVENTOR(S) : Ashida et al

It is certified that error appears in the above-identified patent and that said Letters Patent is hereby corrected as shown below:

Column 2, line 33 "10 wt %" should read --10 %--.

Column 3, line 14 "35 wt %" should read --35%--.

Column 3, line 15 "35 wt %" should read --35%--.

Column 3, line 50 "95 wt %" should read --95%--.

Column 6, line 50 "10 wt %" should read --10%--.

Column 12, line 48 "10 wt %" should read --10%--.

Column 13, line 22 "10 wt. %" should read --10%--.

Column 13, line 26 "wt T" should read --wt %--.

Signed and Sealed this

Twelfth Day of August, 1997

Bruce Lehman

*Attest:*

BRUCE LEHMAN

*Attesting Officer*

*Commissioner of Patents and Trademarks*